US010847092B2

(12) United States Patent
Bae et al.

(10) Patent No.: US 10,847,092 B2
(45) Date of Patent: Nov. 24, 2020

(54) METHOD OF OPERATING AN ORGANIC LIGHT EMITTING DISPLAY DEVICE AND ORGANIC LIGHT EMITTING DISPLAY DEVICE

(71) Applicant: Samsung Display Co., Ltd., Yongin-si (KR)

(72) Inventors: Min-Seok Bae, Hwaseong-si (KR); Dong Won Lee, Suwon-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 16/197,959

(22) Filed: Nov. 21, 2018

(65) Prior Publication Data

US 2019/0164494 A1 May 30, 2019

(30) Foreign Application Priority Data

Nov. 28, 2017 (KR) ..... 10-2017-0160996

(51) Int. Cl.

| | |
|---|---|
| ***G09G 3/3258*** | (2016.01) |
| ***G09G 3/3291*** | (2016.01) |
| ***G09G 3/3233*** | (2016.01) |
| *G09G 3/3266* | (2016.01) |

(52) U.S. Cl.

CPC ..... *G09G 3/3258* (2013.01); *G09G 3/3233* (2013.01); *G09G 3/3266* (2013.01); *G09G 3/3291* (2013.01); *G09G 2300/0819* (2013.01); *G09G 2300/0842* (2013.01);

(Continued)

(58) Field of Classification Search

CPC .. G09G 3/3258; G09G 3/3233; G09G 3/3266; G09G 3/3291; G09G 2300/0819; G09G 2300/0842; G09G 2300/0861; G09G 2300/0866; G09G 2310/08; G09G 2320/0257

See application file for complete search history.

(56) References Cited

U.S. PATENT DOCUMENTS

2005/0088378 A1* 4/2005 Ozawa ..... G09G 3/3233 345/76
2007/0236430 A1* 10/2007 Fish ..... G09G 3/3233 345/82

(Continued)

FOREIGN PATENT DOCUMENTS

KR 10-2015-0064543 A 6/2015
KR 10-2016-0148790 A 12/2016
KR 10-2017-0083689 A 7/2017

*Primary Examiner* — Stephen G Sherman
(74) *Attorney, Agent, or Firm* — Lewis Roca Rothgerber Christie LLP

(57) ABSTRACT

In a method of operating an organic light emitting display device including a plurality of pixels, an initialization voltage is applied to the plurality of pixels to store the initialization voltage in the plurality of pixels in a first period of an initial period. Driving transistors of the plurality of pixels are concurrently turned on based on the stored initialization voltage in a second period of the initial period, and a plurality of data voltages are sequentially applied to the plurality of pixels on a row-by-row basis to store the plurality of data voltages in the plurality of pixels in a data write period. The plurality of pixels concurrently emit light based on the plurality of data voltages in an emission period.

20 Claims, 13 Drawing Sheets

(52) U.S. Cl.
CPC ..... *G09G 2300/0861* (2013.01); *G09G 2300/0866* (2013.01); *G09G 2310/08* (2013.01); *G09G 2320/0257* (2013.01)

(56) References Cited

U.S. PATENT DOCUMENTS

| | | | | |
|---|---|---|---|---|
| 2011/0157256 | A1* | 6/2011 | Sakamoto | G09G 3/344 345/690 |
| 2012/0019499 | A1* | 1/2012 | Hwang | G09G 3/325 345/211 |
| 2012/0242643 | A1* | 9/2012 | Ono | G09G 3/3233 345/212 |
| 2016/0275869 | A1* | 9/2016 | Hwang | G09G 3/3258 |
| 2017/0125502 | A1* | 5/2017 | Ota | G02B 27/017 |
| 2018/0144717 | A1* | 5/2018 | Kim | G09G 5/10 |

* cited by examiner

METHOD OF OPERATING AN ORGANIC LIGHT EMITTING DISPLAY DEVICE AND ORGANIC LIGHT EMITTING DISPLAY DEVICE

CROSS-REFERENCE TO RELATED APPLICATION

This application claims priority to and the benefit of Korean Patent Application No. 10-2017-0160996, filed on Nov. 28, 2017 in the Korean Intellectual Property Office (KIPO), the content of which is incorporated herein in its entirety by reference.

BACKGROUND

1. Field

Exemplary embodiments of the present inventive concept relate to display devices, and more particularly to methods of operating organic light emitting display devices and the organic light emitting display devices.

2. Description of the Related Art

In an organic light emitting display device, a driving transistor included in each pixel may generate a driving current, and an organic light emitting diode (OLED) included in the pixel may emit light with luminance corresponding to an amount of the driving current. However, a voltage-current characteristic of the driving transistor may be changed according to an operating state of the driving transistor in a previous display frame. In other words, the driving transistors included in the pixels of the organic light emitting display device may have hysteresis. In a case where the organic light emitting display device has displayed a black image in previous display frames, and displays a white image in the next display frames, luminance of the organic light emitting display device in the first display frame where the white image is displayed may be lower than desired luminance due to the hysteresis of the driving transistors. This phenomenon may be referred to as step efficiency. Further in a case where display regions within a display panel are driven with different gray levels in previous display frames, the display regions may emit different luminances for a certain time even if the display regions are driven with the same gray level in the next display frames, due to the hysteresis of the driving transistors. This may be referred to as instantaneous afterimage.

SUMMARY

Some example embodiments provide a method of operating an organic light emitting display device capable of preventing step efficiency and/or an instantaneous afterimage.

Some example embodiments provide an organic light emitting display device capable of preventing step efficiency and/or an instantaneous afterimage.

According to example embodiments, there is provided a method of operating an organic light emitting display device including a plurality of pixels. In the method, an initialization voltage is applied to the plurality of pixels to store the initialization voltage in the plurality of pixels in a first period of an initial period, driving transistors of the plurality of pixels are simultaneously turned on based on the stored initialization voltage in a second period of the initial period, a plurality of data voltages are sequentially applied to the plurality of pixels on a row-by-row basis to store the plurality of data voltages in the plurality of pixels in a data write period, and the plurality of pixels simultaneously emit light based on the plurality of data voltages in an emission period.

In example embodiments, in the second period of the initial period, a same on-current may flow from a first power supply voltage through the simultaneously turned-on driving transistors into the initialization voltage, and hysteresis of the driving transistors may be reset by the same on-current.

In example embodiments, the initialization voltage may have an on-voltage level for turning on the driving transistors of the plurality of pixels in the first period of the initial period.

In example embodiments, the initialization voltage may have a voltage level a same as a voltage level of a white data voltage in the first period of the initial period.

In example embodiments, a plurality of initialization control signals may be sequentially applied to initializing transistors of the plurality of pixels on the row-by-row basis to sequentially apply the initialization voltage to the plurality of pixels on the row-by-row basis in the first period of the initial period.

In example embodiments, a plurality of initialization control signals may be simultaneously applied to initializing transistors of the plurality of pixels to simultaneously apply the initialization voltage to the plurality of pixels in the first period of the initial period.

In example embodiments, a plurality of initialization control signals may be applied to initializing transistors of the plurality of pixels on a pixel block-by-pixel block basis to apply the initialization voltage to the plurality of pixels on the pixel block-by-pixel block basis in the first period of the initial period, where each pixel block includes at least two pixel rows.

In example embodiments, to simultaneously turn on the driving transistors of the plurality of pixels, a plurality of emission control signals may be simultaneously applied to emission transistors of the plurality of pixels in the second period of the initial period.

In example embodiments, when the driving transistors of the plurality of pixels are simultaneously turned on, a plurality of bypass signals may be simultaneously applied to bypass transistors of the plurality of pixels in the second period of the initial period.

In example embodiments, a voltage level of a second power supply voltage connected to organic light emitting diodes of the plurality of pixels may be changed such that the second power supply voltage has a voltage level higher than or equal to that of the stored initialization voltage during the initial period.

In example embodiments, it may be determined whether an operation mode of the organic light emitting display device is a normal mode or a moving image mode. The initial period may be included in each display frame in the moving image mode, and may not be included in each display frame in the normal mode.

According to example embodiments, there is provided an organic light emitting display device including a display panel including a plurality of pixels, a scan driver configured to apply a plurality of scan signals, a plurality of initialization control signals and a plurality of bypass signals to the plurality of pixels, a data driver configured to apply a plurality of data voltages to the plurality of pixels, an emission driver configured to apply a plurality of emission control signals to the plurality of pixels, and a power supply unit configured to generate an initialization voltage. Storage capacitors of the plurality of pixels store the initialization voltage in a first period of an initial period, and driving transistors of the plurality of pixels are simultaneously turned on based on the stored initialization voltage in a second period of the initial period.

In example embodiments, the plurality of pixels may store the plurality of data voltages in response to the plurality of scan signals that are sequentially applied on a row-by-row basis in a data write period, and may simultaneously emit light based on the plurality of data voltages in response to the plurality of emission control signals that are simultaneously applied in an emission period.

In example embodiments, in the second period of the initial period, a same on-current may flow from a first power supply voltage through the simultaneously turned-on driving transistors into the initialization voltage, and hysteresis of the driving transistors may be reset by the same on-current.

In example embodiments, the initialization voltage may have a voltage level a same as a voltage level of a white data voltage in the first period of the initial period.

In example embodiments, each of the plurality of pixels may include the driving transistor, the storage capacitor connected between a gate of the driving transistor and a first power supply voltage, a switching transistor configured to transfer the data voltage to a source of the driving transistor in response to the scan signal, a compensating transistor configured to diode-connect the driving transistor in response to the scan signal, an initializing transistor configured to apply the initialization voltage to the gate of the driving transistor and the storage capacitor in response to the initialization control signal, a first emission transistor configured to connect the first power supply voltage to the source of the driving transistor in response to the emission control signal, a second emission transistor configured to connect a drain of the driving transistor to an organic light emitting diode in response to the emission control signal, a bypass transistor configured to connect the initialization voltage to the organic light emitting diode in response to the bypass signal, and the organic light emitting diode connected between the second emission transistor and a second power supply voltage.

In example embodiments, the scan driver may apply the plurality of initialization control signals to the initializing transistors of the plurality of pixels to store the initialization voltage in the storage capacitors of the plurality of pixels in the first period of the initial period.

In example embodiments, the scan driver may simultaneously apply the plurality of bypass signals to the bypass transistors of the plurality of pixels in the second period of the initial period, and the emission driver may simultaneously apply the plurality of emission control signals to the first and second emission transistors of the plurality of pixels in the second period of the initial period.

In example embodiments, the second power supply voltage may have a voltage level higher than or equal to that of the stored initialization voltage during the initial period.

In example embodiments, the organic light emitting display device may further include an operation mode determining unit configured to determine whether an operation mode of the organic light emitting display device is a normal mode or a moving image mode. The initial period may be included in each display frame in the moving image mode, and may not be included in each display frame in the normal mode.

As described above, the method of operating the organic light emitting display device, and the organic light emitting display device according to example embodiments may apply the initialization voltage to the plurality of pixels in the first period of the initial period, and may simultaneously turn on the driving transistors of the plurality of pixels based on the initialization voltage in the second period of the initial period, thereby preventing the step efficiency and/or the instantaneous afterimage by resetting the hysteresis of the driving transistors.

BRIEF DESCRIPTION OF THE DRAWINGS

Illustrative, non-limiting example embodiments will be more clearly understood from the following detailed description in conjunction with the accompanying drawings.

DETAILED DESCRIPTION

Figure 1:
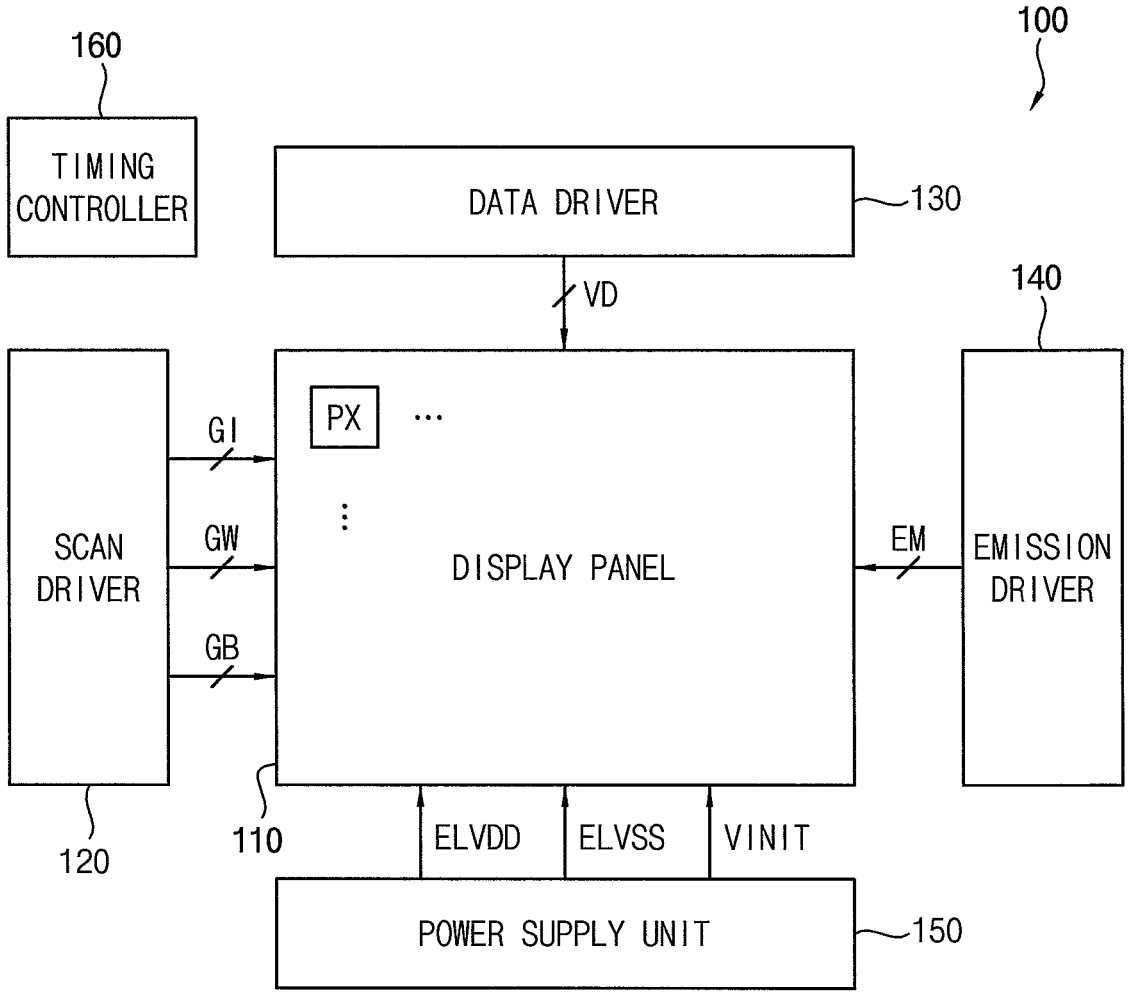
FIG. 1 is a block diagram illustrating an organic light emitting display device according to example embodiments.

Hereinafter, example embodiments will be described in more detail with reference to the accompanying drawings, in which like reference numbers refer to like elements throughout. The present invention, however, may be embodied in various different forms, and should not be construed as being limited to only the illustrated embodiments herein. Rather, these embodiments are provided as examples so that this disclosure will be thorough and complete, and will fully convey the aspects and features of the present invention to those skilled in the art. Accordingly, processes, elements, and techniques that are not necessary to those having ordinary skill in the art for a complete understanding of the aspects and features of the present invention may not be described. Unless otherwise noted, like reference numerals denote like elements throughout the attached drawings and the written description, and thus, descriptions thereof will not be repeated. In the drawings, the relative sizes of elements, layers, and regions may be exaggerated for clarity.

It will be understood that, although the terms "first," "second," "third," etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present invention.

Spatially relative terms, such as "beneath," "below," "lower," "under," "above," "upper," and the like, may be used herein for ease of explanation to describe one element or feature's relationship to another element(s) or feature(s) as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly.

It will be understood that when an element or layer is referred to as being "on," "connected to," or "coupled to" another element or layer, it can be directly on, connected to, or coupled to the other element or layer, or one or more intervening elements or layers may be present. In addition, it will also be understood that when an element or layer is referred to as being "between" two elements or layers, it can be the only element or layer between the two elements or layers, or one or more intervening elements or layers may also be present.

The terminology used herein is for the purpose of describing particular embodiments only and is not intended to be limiting of the present invention. As used herein, the singular forms "a" and "an" are intended to include the plural forms as well, unless the context clearly indicates otherwise. It will be further understood that the terms "comprises," "comprising," "includes," and "including," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list.

As used herein, the term "substantially," "about," and similar terms are used as terms of approximation and not as terms of degree, and are intended to account for the inherent deviations in measured or calculated values that would be recognized by those of ordinary skill in the art. Further, the use of "may" when describing embodiments of the present invention refers to "one or more embodiments of the present invention." As used herein, the terms "use," "using," and "used" may be considered synonymous with the terms "utilize," "utilizing," and "utilized," respectively. Also, the term "exemplary" is intended to refer to an example or illustration.

The electronic or electric devices and/or any other relevant devices or components according to embodiments of the present invention described herein may be implemented utilizing any suitable hardware, firmware (e.g., an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate. Further, the various components of these devices may be may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the exemplary embodiments of the present invention.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein. FIG. 1 is a block diagram illustrating an organic light emitting display device according to example embodiments.

Referring to FIG. 1, an organic light emitting display device 100 may include a display panel 110 including a plurality of pixels PX, a scan driver 120 that applies a plurality of scan signals GW, a plurality of initialization control signals GI and a plurality of bypass signals GB to the plurality of pixels PX, a data driver 130 that applies a plurality of data voltages VD to the plurality of pixels PX, an emission driver 140 that applies a plurality of emission control signals EM to the plurality of pixels PX, and a power supply unit 150 that generates a first power supply voltage ELVDD, a second power supply voltage ELVSS and an initialization voltage VINIT. The organic light emitting display device 100 may further include a timing controller 160 that controls the scan driver 120, the data driver 130, the emission driver 140 and the power supply unit 150.

The display panel 110 may be connected to the scan driver 120 through a plurality of scan lines, a plurality of initialization control lines and a plurality of bypass lines, may be connected to the data driver 130 through a plurality of data lines, and may be connected to the emission driver 140 through a plurality of emission control lines. The display panel 110 may include the plurality of pixels PX located at crossings of the plurality of data lines and the plurality of scan lines. Each pixel PX may include an organic light emitting diode (OLED), and the display panel 110 may be an OLED display panel.

The scan driver 120 may apply the plurality of scan signals GW to the plurality of pixels PX through the plurality of scan lines, may apply the plurality of initialization control signals GI to the plurality of pixels PX through the plurality of initialization control lines, and may apply the plurality of bypass signals GB to the plurality of pixels PX through the plurality of bypass lines. The data driver 130 may apply the plurality of data voltages VD to the plurality of pixels PX through the plurality of data lines. The emission driver 140 may apply the plurality of emission control signals EM to the plurality of pixels PX through the plurality of emission control lines. The timing controller 160 may control operation timings of the scan driver 120, the data driver 130, the emission driver 140 and the power supply unit 150.

Each display frame of the organic light emitting display device 100 may include a data write period in which the plurality of data voltages VD are written to the plurality of pixels PX and an emission period in which the plurality of pixels PX emit light. The organic light emitting display device 100 may also have an initial period (or an initialization period) in which driving transistors of the plurality of pixels PX are turned on. The initialization voltage VINIT may be stored in the plurality of pixels PX in a first period of the initial period, and the driving transistors of the plurality of pixels PX may be simultaneously turned on based on the initialization voltage VINIT in a second period of the initial period. Accordingly, hysteresis of the driving transistors, or voltage-current characteristics of the driving transistors, may be reset.

In a conventional organic light emitting display devices, driving transistors of pixels driven with different gray levels in previous display frames (e.g., a pixel driven with a white gray level and a pixel driven with a black gray level in the previous display frames), may have different voltage-current characteristics. That is, the driving transistors of the pixels of the conventional organic light emitting display device may have hysteresis. For example, in a case where the organic light emitting display device has displayed a black image in previous display frames, and displays a white image in the next display frames, luminance of the organic light emitting display device in the first display frame where the white image is displayed may be lower than desired luminance. This reduced luminance may be referred to as step efficiency. Further, due to the hysteresis of the driving transistors, in a case where display regions within a display panel are driven with different gray levels in previous display frames, the display regions may emit with different luminances for a certain time even if the display regions are driven with the same gray level in the next display frames. This uneven luminance may be referred to as instantaneous afterimage.

According to example embodiments, in the organic light emitting display device 100, the initialization voltage VINIT may be applied to the plurality of pixels PX in the first period of the initial period, and the driving transistors of the plurality of pixels PX may be concurrently (e.g., substantially simultaneously) turned on based on the initialization voltage VINIT in the second period of the initial period, thereby preventing the step efficiency and/or the instantaneous afterimage by resetting the hysteresis of the driving transistors.

Hereinafter, a method of operating the organic light emitting display device 100 according to example embodiments will be described below with reference to FIGS. 1 through 3.

Figure 2:
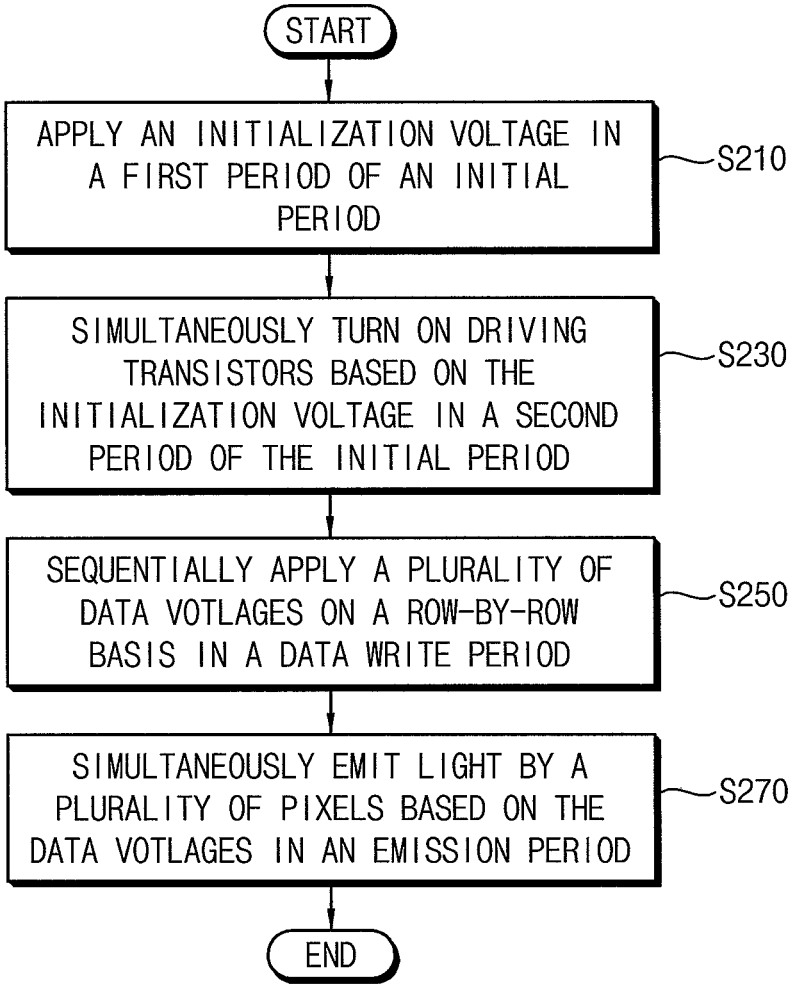
FIG. 2 is a flowchart illustrating a method of operating an organic light emitting display device according to example embodiments.
Figure 3:
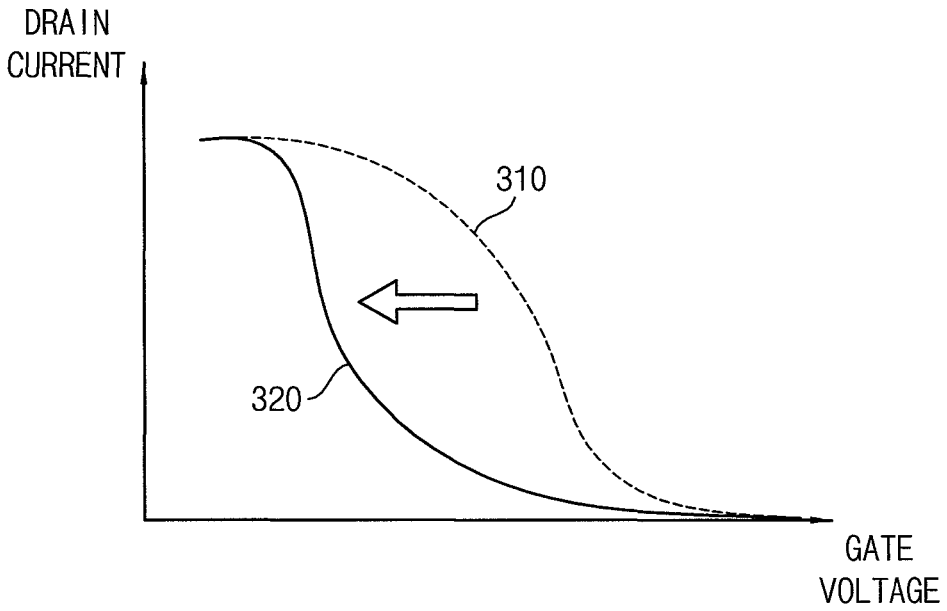
FIG. 3 is a graph illustrating a voltage-current characteristic of driving transistors of pixels included in an organic light emitting display device according to example embodiments.

FIG. 2 is a flowchart illustrating a method of operating an organic light emitting display device according to example embodiments, and FIG. 3 is a graph illustrating a voltage-current characteristic of driving transistors of pixels included in an organic light emitting display device according to example embodiments.

Referring to FIGS. 1 and 2, a method of operating an organic light emitting display device 100 includes an initial period having a first period and a second period. In the first period of the initial period, a power supply unit 150 may apply an initialization voltage VINIT to a plurality of pixels PX, a scan driver 120 may apply a plurality of initialization control signals GI to the plurality of pixels PX, and thus the initialization voltage VINIT may be stored in storage capacitors of the plurality of pixels PX (S210). The power supply unit 150 may generate the initialization voltage VINIT having an on-voltage level for turning on driving transistors of the plurality of pixels PX in the first period of the initial period. In some example embodiments, the initialization voltage VINIT may have a voltage level the same as that of a data voltage corresponding to the maximum gray level, or that of a white data voltage in the first period of the initial period.

In the second period of the initial period, the driving transistors of the plurality of pixels PX may be concurrently (e.g. substantially simultaneously) turned on based on the initialization voltage VINIT that is stored in the first period of the initial period (S230). Based on the stored initialization voltage VINIT, the substantially same on-current may flow from a first power supply voltage ELVDD through the concurrently (e.g., substantially simultaneously) turned-on driving transistors into the initialization voltage supply VINIT in the second period of the initial period, and thus hysteresis of the driving transistors may be reset by the same on-current.

The driving transistors of the plurality of pixels PX may have different voltage-current characteristics according to operating states of the driving transistor in previous display frames. For example, as illustrated in FIG. 3, a driving transistor of a pixel PX driven with the minimum gray level in previous display frames, or a driving transistor of a pixel PX driven based on a black data voltage in the previous display frames may have a first voltage-current characteristic 310, and a driving transistor of a pixel PX driven with the maximum gray level in the previous display frames, or a driving transistor of a pixel PX driven based on a white data voltage in the previous display frames may have a second voltage-current characteristic 320. Accordingly, step efficiency and/or an instantaneous afterimage may occur, and image quality may be degraded. However, in the method of driving the organic light emitting display device 100, the driving transistors of the plurality of pixels PX may be concurrently (e.g., substantially simultaneously) turned on based on the initialization voltage VINIT having a predetermined voltage level, for example with a voltage level that is the same as the white data voltage in the initial period, and thus may have the same second voltage-current characteristic 320. Accordingly, the step efficiency and/or the instantaneous afterimage may be prevented.

In a data write period, a data driver 130 may apply a plurality of data voltages VD to the plurality of pixels PX, the scan driver 120 may sequentially apply the plurality of scan signals GW to the plurality of pixels PX on a row-by-row basis, and thus the plurality of data voltages VD may be sequentially applied to the plurality of pixels PX on the row-by-row basis (S250). In some example embodiments, in the data write period, the scan driver 120 may further apply a plurality of initialization control signals GI and a plurality of bypass signals GB to the plurality of pixels PX, and thus a gate initialization operation for the driving transistors and an anode initialization operation for organic light emitting diodes of the plurality of pixels PX may be performed.

In an emission period, an emission driver 140 may concurrently (e.g., substantially simultaneously) apply a plurality of emission control signals EM to the plurality of pixels PX, and thus the plurality of pixels PX may simultaneously emit light based on the plurality of data voltages VD (S270). That is, the organic light emitting display device 100 according to example embodiments may be a simultaneous emission type organic light emitting display device where the plurality of pixels PX simultaneously emits light.

As described above, in the method of operating the organic light emitting display device 100 according to example embodiments, the initialization voltage VINIT may be applied to the plurality of pixels PX in the first period of the initial period, and the driving transistors of the plurality of pixels PX may be concurrently (e.g., substantially simultaneously) turned on based on the initialization voltage VINIT in the second period of the initial period, thereby preventing the step efficiency and/or the instantaneous after-image by resetting the hysteresis of the driving transistors.

Figure 4:
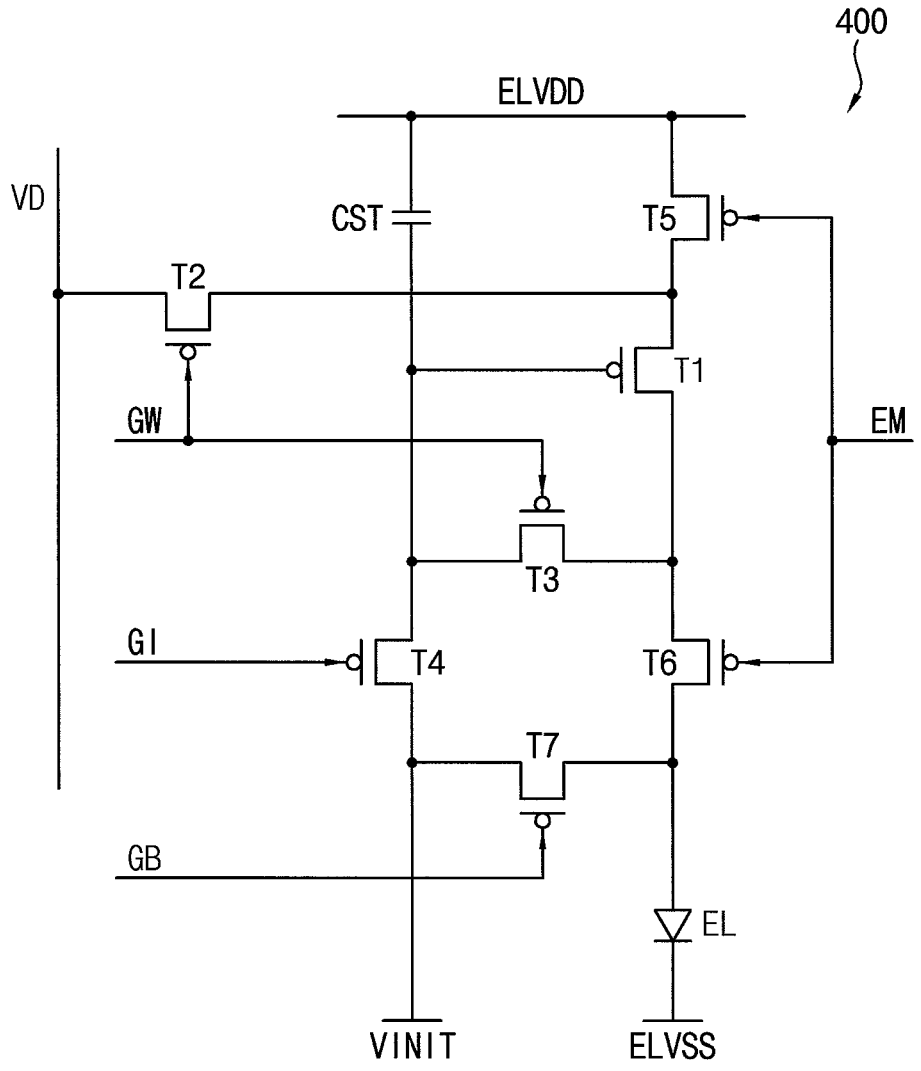
FIG. 4 is a circuit diagram illustrating a pixel included in an organic light emitting display device according to example embodiments.

FIG. 4 is a circuit diagram illustrating a pixel included in an organic light emitting display device according to example embodiments.

Referring to FIG. 4, each pixel 400 may include a storage capacitor CST, a driving transistor T1, a switching transistor T2, a compensating transistor T3, an initializing transistor T4, a first emission transistor T5, a second emission transistor T6, a bypass transistor T7 and an organic light emitting diode EL.

The driving transistor T1 may generate a driving current based on a voltage stored in the storage capacitor CST. In some example embodiments, the driving transistor T1 may be implemented as a PMOS transistor including a gate connected to the storage capacitor CST, a source connected to the switching transistor T2 and the first emission transistor T5, and a drain connected to the compensating transistor T3 and the second emission transistor T6.

The switching transistor T2 may transfer a data voltage VD to the source of the driving transistor T1 in response to a scan signal GW. In some example embodiments, the switching transistor T2 may be implemented as a PMOS transistor including a gate receiving the scan signal GW, a source connected to a data line, and a drain connected to the source of the driving transistor T1.

The compensating transistor T3 may diode-connect the driving transistor T1 in response to the scan signal GW. In some example embodiments, the compensating transistor T3 may be implemented as a PMOS transistor including a gate receiving the scan signal GW, a source connected to the drain of the driving transistor T1, and a drain connected to the gate of the driving transistor T1 and the storage capacitor CST.

The storage capacitor CST may be connected between the gate of the driving transistor T1 and a first power supply voltage ELVDD. In some example embodiments, the storage capacitor CST may include a first electrode connected to the first power supply voltage ELVDD, and a second electrode connected to the gate of the driving transistor T1, the drain of the compensating transistor T3 and the initializing transistor T4. In a data write period, the data voltage VD may be applied to the source of the driving transistor T1 through the switching transistor T2, a compensation voltage where a negative threshold voltage of the driving transistor T1 is added to the data voltage VD may be applied to the second electrode of the storage capacitor CST through the driving transistor T1 that is diode-connected by the compensating transistor T3, and the storage capacitor CST may store a voltage difference between the first power supply voltage ELVDD and the compensation voltage. Thereafter, in an emission period, the driving transistor T1 may be driven based on the compensation voltage at the second electrode of the storage capacitor CST, and thus the driving current may be generated regardless of the threshold voltage of the driving transistor T1.

The initializing transistor T4 may apply an initialization voltage VINIT to the gate of the driving transistor T1 and the second electrode of the storage capacitor CST in response to an initialization control signal GI. In some example embodiments, the initializing transistor T4 may be implemented as a PMOS transistor including a gate receiving the initialization control signal GI, a source (or a drain) connected to the initialization voltage VINIT, and a drain (or a source) connected to the gate of the driving transistor T1 and the second electrode of the storage capacitor CST.

In some example embodiments, in a first period of an initial period, the initialization voltage VINIT may have an on-voltage level, for example a voltage level of a white data voltage, and the initializing transistor T4 may apply the initialization voltage VINIT having the voltage level of the white data voltage to the second electrode of the storage capacitor CST in response to the initialization control signal GI. For example, the initialization voltage VINIT may have, but not limited to, a voltage level of about 2V in the first period of the initial period. Thereafter, in a second period of the initial period, the driving transistor T1 may be turned on based on the initialization voltage VINIT having the voltage level of the white data voltage at the second electrode of the storage capacitor CST, and thus hysteresis of the driving transistor T1 may be reset.

Further, in some example embodiments, in the data write period, the initialization voltage VINIT may have an initialization voltage level, and the initializing transistor T4 may apply the initialization voltage VINIT having the initialization voltage level to the gate of the driving transistor T1 in response to the initialization control signal GI. For example, the initialization voltage level may be, but not limited to, about −3V. The gate of the driving transistor T1 may be initialized by the initialization voltage VINIT having the initialization voltage level, thereby preventing an error of a threshold voltage compensating operation by the compensating transistor T3.

The first emission transistor T5 may connect the first power supply voltage ELVDD to the source of the driving transistor T1 in response to an emission control signal EM, and the second emission transistor T6 may connect the drain of the driving transistor T1 to the organic light emitting diode EL in response to the emission control signal EM. In some example embodiments, the first emission transistor T5 may be implemented as a PMOS transistor including a gate receiving the emission control signal EM, a source connected to the first power supply voltage ELVDD, and a drain connected to the source of the driving transistor T1, and the second emission transistor T6 may be implemented as a PMOS transistor including a gate receiving the emission control signal EM, a source connected to the drain of the driving transistor T1, and a drain connected to the organic light emitting diode EL and the bypass transistor T7. In the second period of the initial period, the first and second emission transistors T5 and T6 may be turned on in response to the emission control signal EM, thereby forming a first current path including the first power supply voltage ELVDD, the first emission transistor T5, the driving transistor T1, the second emission transistor T6, the bypass transistor T7 and the initialization voltage VINIT. Thus, an on-current may flow through the first current path. During the emission period, the first and second emission transistors T5 and T6 may be turned on in response to the emission control signal EM, thereby forming a second current path including the first power supply voltage ELVDD, the first emission transistor T5, the driving transistor T1, the second emission transistor T6, the organic light emitting diode EL and a second power supply voltage ELVSS. Thus, the driving current may flow through the second current path.

The bypass transistor T7 may connect the initialization voltage VINIT to the organic light emitting diode EL and the drain of the second emission transistor T6 in response to a bypass signal GB. In some example embodiments, the bypass transistor T7 may be implemented as a PMOS transistor including a gate receiving the bypass signal GB, a source (or a drain) connected to the initialization voltage VINIT, and a drain (or a source) connected to the organic light emitting diode EL and the drain of the second emission transistor T6. In the second period of the initial period, the bypass transistor T7 may be turned on in response to the bypass signal GB, thereby forming the first current path where the on-current flows. Further, in the data write period, the bypass transistor T7 may be turned on in response to the bypass signal GB to apply the initialization voltage VINIT to an anode of the organic light emitting diode EL, and thus a voltage of the anode of the organic light emitting diode EL may be initialized. Because the voltage of the anode of the organic light emitting diode EL is initialized by the initialization voltage VINIT having the initialization voltage level, an undesired light emission phenomenon where the pixel 400 minutely emits light although a black data voltage is applied to the pixel 400 may be prevented. Further, in the emission period, a turned-off bypass transistor T7 may form a bypass current path, and thus the undesired light emission phenomenon may be further prevented.

The organic light emitting diode EL may be connected between the second emission transistor T6 and the second power supply voltage ELVSS. In some example embodiments, the organic light emitting diode EL may have the anode connected to the drain of the second emission transistor T6 and the drain of the bypass transistor T7, and a cathode connected to the second power supply voltage ELVSS.

Figure 5:
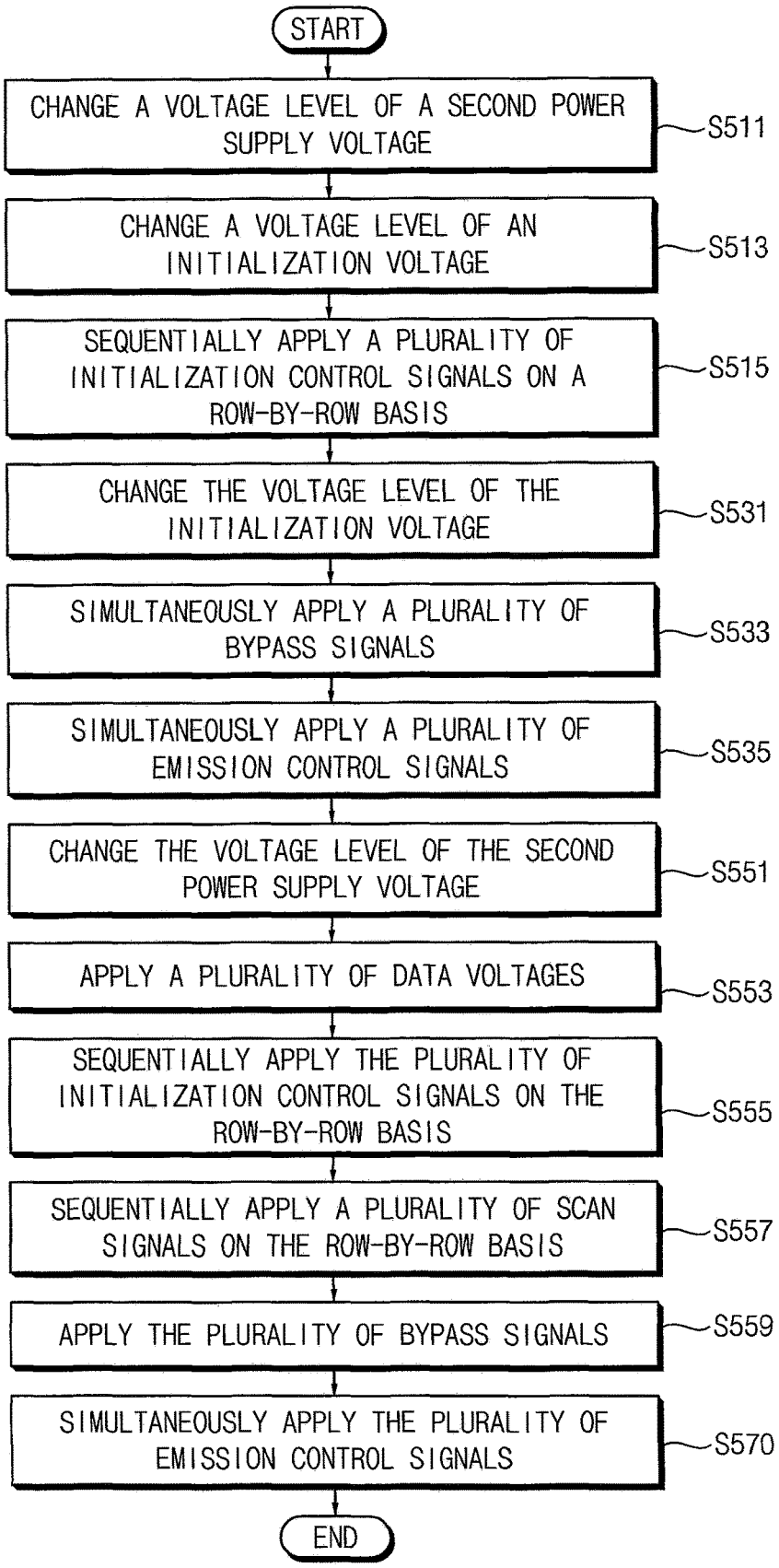
FIG. 5 is a flowchart illustrating a method of operating an organic light emitting display device according to example embodiments.
Figure 6:
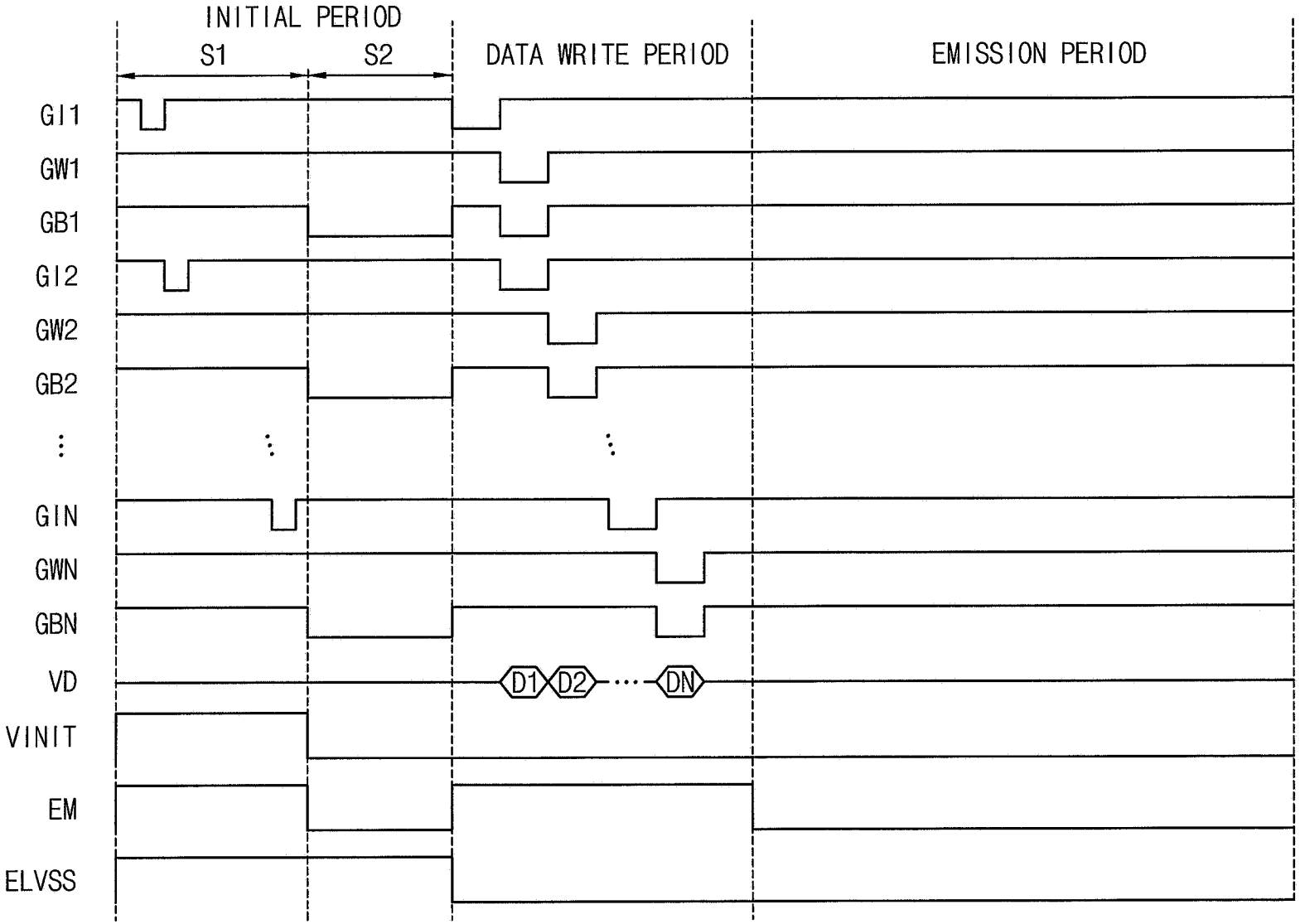
FIG. 6 is a timing diagram for describing a method of operating an organic light emitting display device according to example embodiments.
Figure 7:
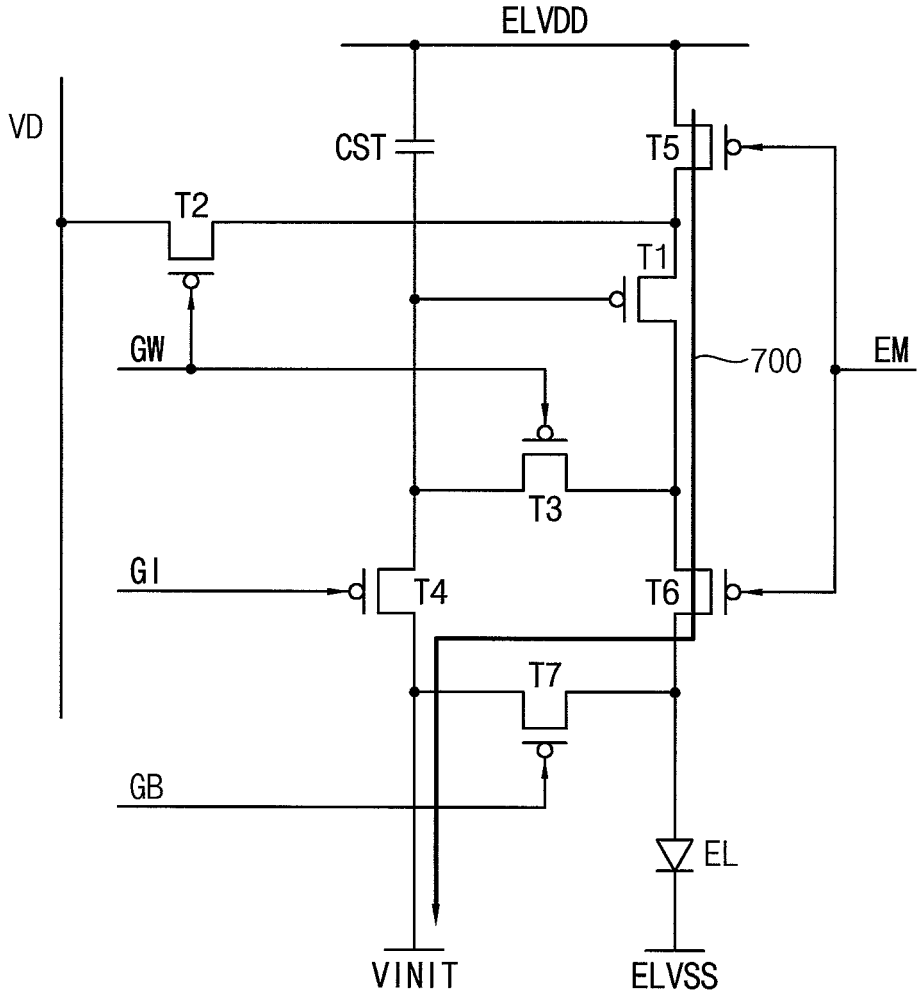
FIG. 7 is a circuit diagram for describing an on-current flowing through a driving transistor of each pixel according to example embodiments.

FIG. 5 is a flowchart illustrating a method of operating an organic light emitting display device according to example embodiments, FIG. 6 is a timing diagram for describing a method of operating an organic light emitting display device according to example embodiments, and FIG. 7 is a circuit diagram for describing an on-current flowing through a driving transistor of each pixel according to example embodiments.

Referring to FIGS. 1, 4, 5, 6 and 7, each display frame of an organic light emitting display device according to example embodiments may include an initial period, a data write period and an emission period.

In a first period S1 of the initial period, a power supply unit 150 may change a voltage level of a second power supply voltage ELVSS (S511), the power supply unit 150 may change a voltage level of an initialization voltage VINIT (S513), and a scan driver 120 may sequentially apply a plurality of initialization control signals GI1, GI2 and GIN to a plurality of pixels PX on a row-by-row basis (S515). Initializing transistors T4 of the plurality of pixels PX may be sequentially turned on in response to the plurality of initialization control signals GI1, GI2 and GIN on the row-by-row basis, and thus the initialization voltage VINIT may be sequentially applied to plurality of pixels PX on the row-by-row basis. In some example embodiments, in the first period S1 of the initial period, the initialization voltage VINIT may be changed to have a voltage level the same as that of a white data voltage, and the second power supply voltage ELVSS also may be changed to have a voltage level the same as the voltage level of the initialization voltage VINIT (or the voltage level of the white data voltage) or greater than the voltage level of the initialization voltage VINIT. For example, in the first period S1 of the initial period, the initialization voltage VINIT may have, but not limited to, a voltage level of about 2V, and the second power supply voltage ELVSS also may have, but not limited to, a voltage level of about 2V. In each pixel 400, because the initializing transistor T4 is turned on in response to the initialization control signal GI, a storage capacitor CST (or a second electrode of the storage capacitor CST) may store the initialization voltage VINIT having the voltage level the same as that of the white data voltage.

In a second period S2 of the initial period, the power supply unit 150 may change the voltage level of the initialization voltage VINIT (S531), the scan driver 120 may simultaneously apply a plurality of bypass signals GB1, GB2 and GBN to a plurality of bypass transistors T7 of the plurality of pixels PX (S533), and an emission driver 140 may concurrently (e.g., substantially simultaneously) apply a plurality of emission control signals EM to a plurality of first and second emission transistors T5 and T6 of the plurality of pixels PX (S535). In some example embodiments, in the second period S2 of the initial period, the initialization voltage VINIT may be changed to have a voltage level in a normal mode, or an initialization voltage level (e.g., about −3V). In the second period S2 of the initial period, driving transistors T1 of the plurality of pixels PX may be concurrently (e.g., substantially simultaneously) turned on, and substantially the same on-current may flow through the driving transistors T1. That is, in each pixel 400, the first and second emission transistors T5 and T6 may be turned on in response to the emission control signal EM, the driving transistor T1 may be turned on based on the initialization voltage VINIT having the voltage level (e.g., about 2V) the same as that of the white data voltage stored in the storage capacitor CST to generate the on-current, and the bypass transistor T7 may be turned on in response to the bypass signal GB. Thus, as illustrated in FIG. 7, a current path 700 from a first power supply voltage ELVDD through the first emission transistor T5, the driving transistor T1, the second emission transistor T6 and the bypass transistor T7 to the bypass transistor T7 may be formed, and the on-current may flow through the current path 700. Accordingly, substantially the same on-current may flow through all the driving transistors T1 included in the plurality of pixels PX, and thus all the driving transistors T1 may have substantially the same voltage-current characteristic. That is, hysteresis of the driving transistors T1 included in the plurality of pixels PX may be reset. Further, in the second period S2 of the initial period, because the second power supply voltage ELVSS connected to an organic light emitting diode EL has a voltage level greater than or equal to the voltage level of the initialization voltage VINIT stored in the storage capacitor CST, the on-current may not flow through the organic light emitting diode EL, and the organic light emitting diode EL may not emit light.

In the data write period, the power supply unit 150 may change the voltage level of the second power supply voltage ELVSS to a voltage level (e.g., about −5V) of the second power supply voltage ELVSS in a normal mode (S551), a data driver 130 may apply a plurality of data voltages D1, D2 and DN to the plurality of pixels PX (S553), and the scan driver 120 may sequentially apply the plurality of initialization control signals GI1, GI2 and GIN to the plurality of pixels PX on the row-by-row basis (S555), may sequentially apply a plurality of scan signals GW1, GW2 and GWN to the plurality of pixels PX on the row-by-row basis (S557), and may sequentially apply the plurality of bypass signals GB1, GB2 and GBN to the plurality of pixels PX on the row-by-row basis (S559). For example, as illustrated in FIG. 6, a first initialization control signal GI1 may be applied to the pixels PX in a first row, and thus a gate initialization operation for the driving transistors T1 of the pixels PX in the first row may be performed. Subsequently, a first scan signal GW1 and a first bypass signal GB1 may be applied to the pixels PX in the first row, a second initialization control signal GI2 may be applied to the pixels PX in a second row, and thus the gate initialization operation for the driving transistors T1 of the pixels PX in the second row as well as writing of a plurality of data voltages D1 (and threshold voltage compensation by compensating transistors T3) and an anode initialization operation for the organic light emitting diodes EL in the pixels PX in the first row may be performed. In this manner, the gate initialization for the pixels PX in the next row as well as the data writing and the anode initialization for the pixels PX in the current row may be performed on the row-by-row basis. Accordingly, the plurality of data voltages D1, D2 and DN where the threshold voltage compensation is performed may be stored in the storage capacitors CST of the plurality of pixels PX included in the organic light emitting display device 100. Although FIG. 6 illustrates an example where the plurality of bypass signals GB1, GB2 and GBN for the anode initialization are sequentially applied on the row-by-row basis, in some example embodiments, the plurality of bypass signals GB1, GB2 and GBN for the anode initialization may be simultaneously applied to all the pixels PX included in the organic light emitting display device 100.

In the emission period, the emission driver 140 may concurrently (e.g., substantially simultaneously) apply the plurality of emission control signals EM to the plurality of first and second emission transistors T5 and T6 of the plurality of pixels PX (S570). Accordingly, the plurality of first and second emission transistors T5 and T6 of the plurality of pixels PX included in the organic light emitting display device 100 may be concurrently (e.g., substantially simultaneously) turned on, a current path from the first power supply voltage ELVDD through the first emission transistors T5, the driving transistors T1, the second emission transistors T6 and the organic light emitting diodes EL into the second power supply voltage ELVSS may be formed, driving currents may be generated by the driving transistors T1 based on voltages stored in the storage capacitors CST, and thus the organic light emitting diodes EL of the plurality of pixels PX may simultaneously emit light.

Figure 8:
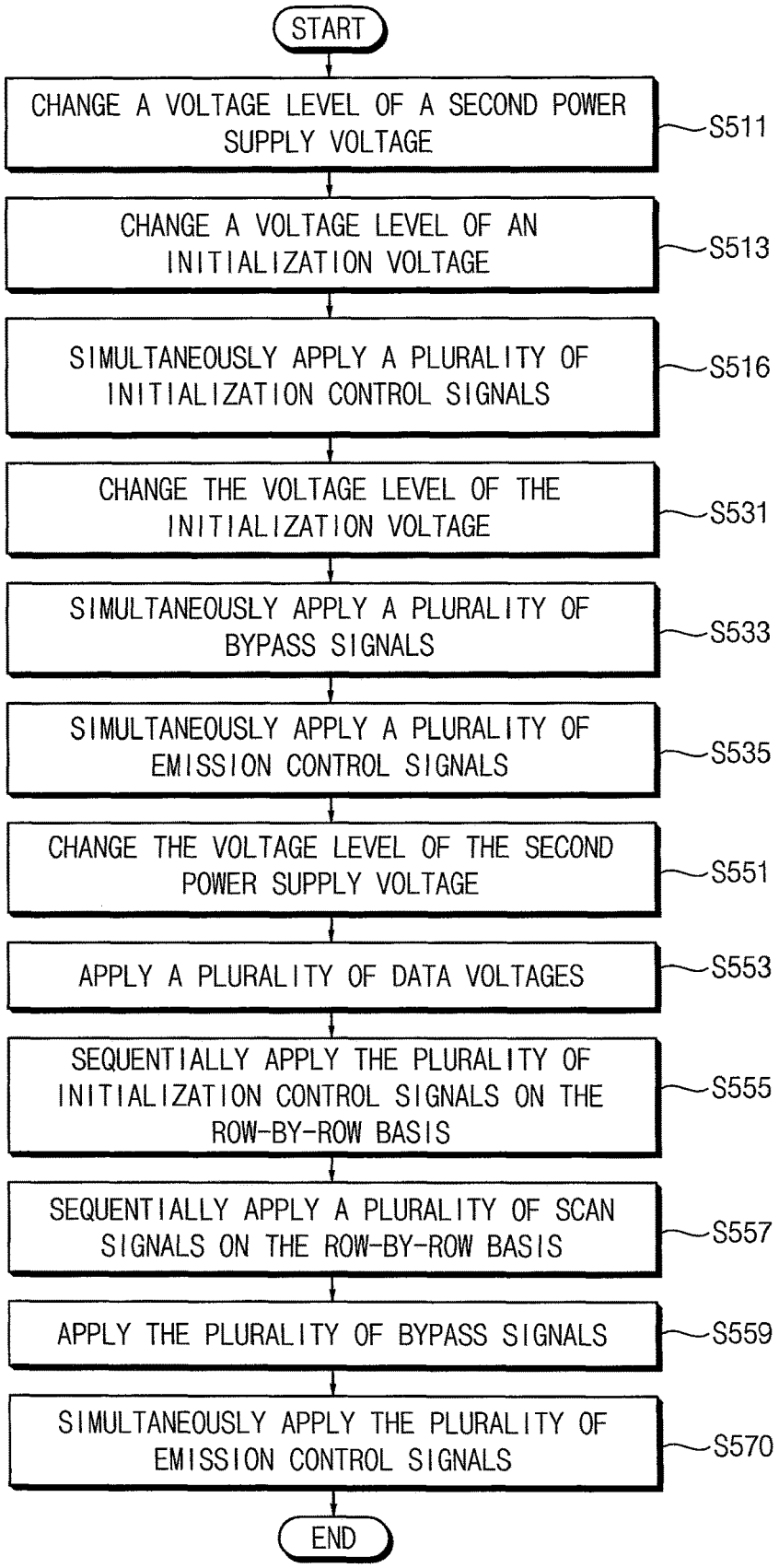
FIG. 8 is a flowchart illustrating a method of operating an organic light emitting display device according to example embodiments.
Figure 9:
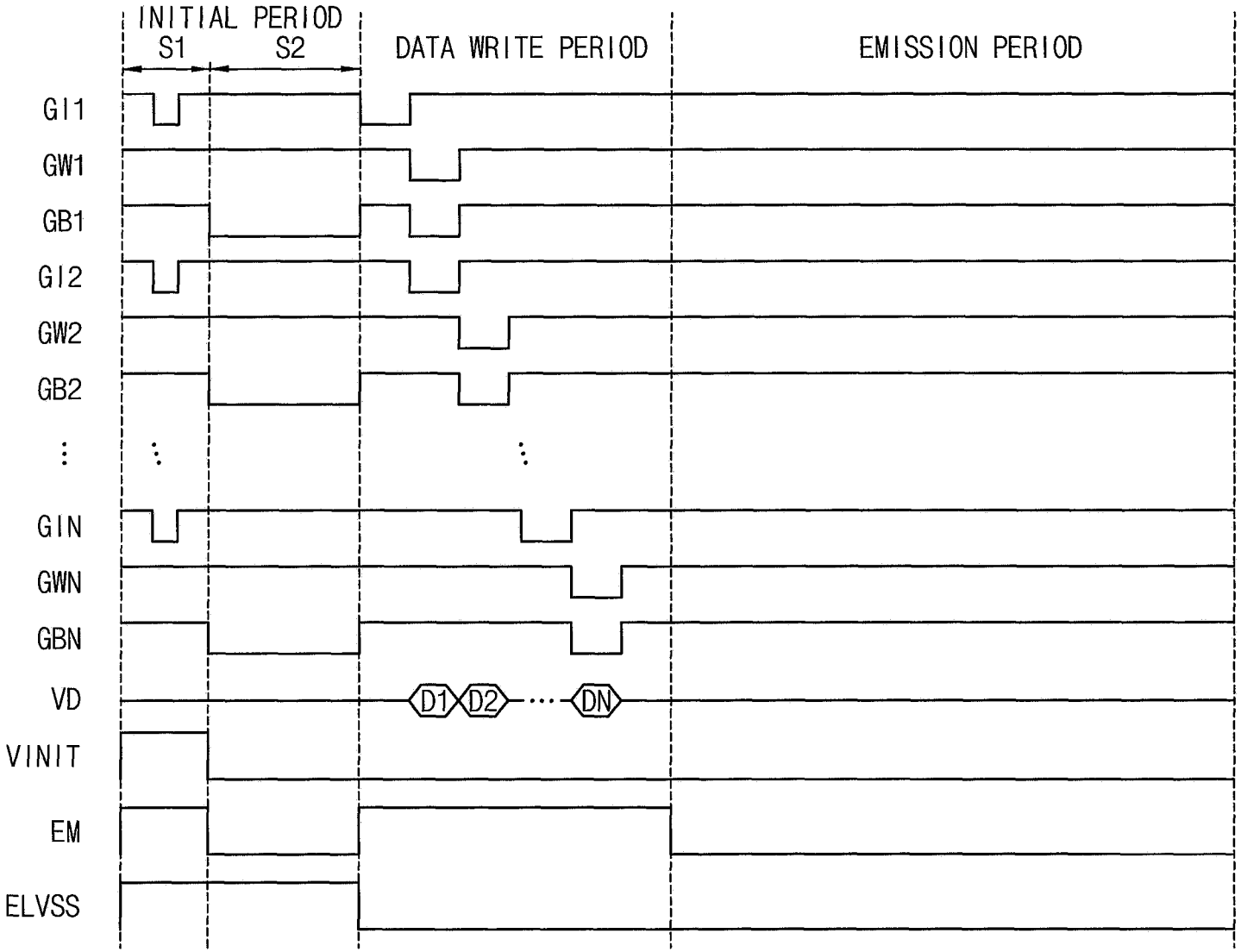
FIG. 9 is a timing diagram for describing a method of operating an organic light emitting display device according to example embodiments.

FIG. 8 is a flowchart illustrating a method of operating an organic light emitting display device according to example embodiments, and FIG. 9 is a timing diagram for describing a method of operating an organic light emitting display device according to example embodiments.

A method of operating an organic light emitting display device illustrated in FIG. 8 may be the same or similar to a method of operating an organic light emitting display device illustrated in FIG. 6, except that a plurality of initialization control signals GI1, GI2 and GIN are concurrently (e.g., substantially simultaneously) applied to a plurality of pixels included in the organic light emitting display device in a first period S1 of an initial period.

Referring to FIGS. 8 and 9, in the first period S1 of the initial period, the plurality of initialization control signals GI1, GI2 and GIN may be substantially simultaneously applied to initializing transistors of the plurality of pixels (S516). Accordingly, in the first period S1 of the initial period, an initialization voltage VINIT may be substantially simultaneously stored in storage capacitors of the plurality of pixels. Because the initialization voltage VINIT may be substantially simultaneously stored, a time length of the initial period may be shortened.

Figure 10:
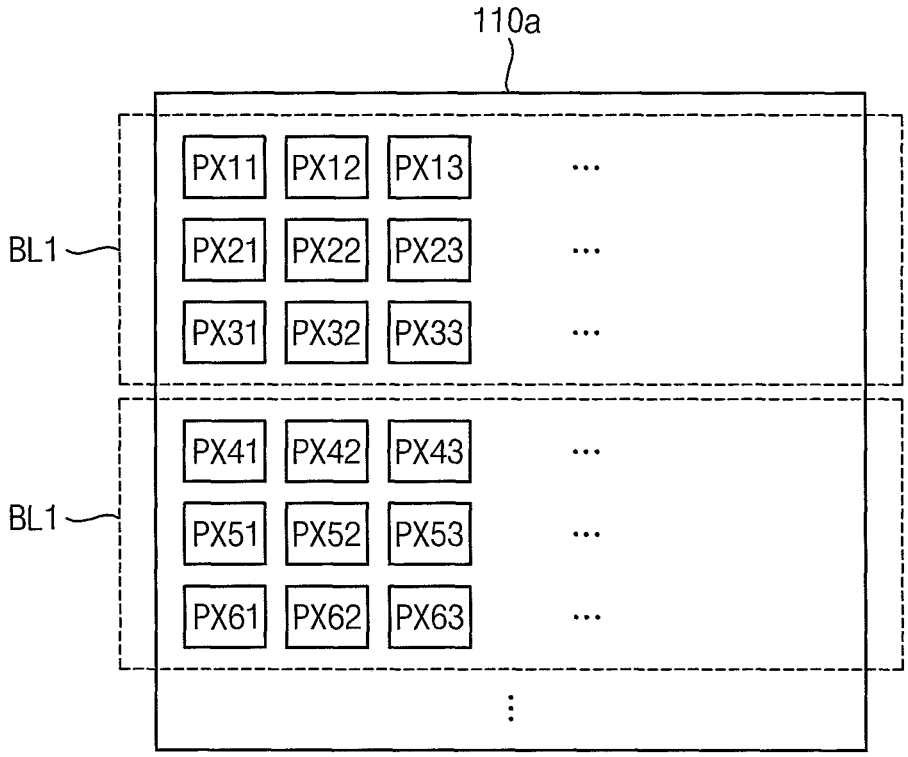
FIG. 10 is a diagram of an example of a display panel for describing a method of operating an organic light emitting display device according to example embodiments.

FIG. 10 is a diagram of an example of a display panel for describing a method of operating an organic light emitting display device according to example embodiments.

Referring to FIG. 10, a display panel 100*a* may be divided into a plurality of pixel blocks BL1 and BL2 each including at least two pixel rows. For example, a first pixel block BL1 may include, but is not limited to, pixels PX11, PX12 and PX13 in a first row, pixels PX21, PX22 and PX23 in a second row and pixels PX31, PX32 and PX33 in a third row, and a second pixel block BL2 may include, but is not limited to, pixels PX41, PX42 and PX43 in a fourth row, pixels PX51, PX52 and PX53 in a fifth row and pixels PX61, PX62 and PX63 in a sixth row. In a first period of an initial period, a plurality of initialization control signals may be applied to the display panel 100*a* on a pixel block-by-pixel block basis. For example, the initialization control signals may be concurrently (e.g., substantially simultaneously) applied to the first pixel block BL1, or the pixels PX11, PX12 and PX13 in the first row, the pixels PX21, PX22 and PX23 in the second row and the pixels PX31, PX32 and PX33 in the third row, and then the initialization control signals may be concurrently (e.g., substantially simultaneously) applied to the second pixel block BL2, or the pixels PX41, PX42 and PX43 in the fourth row, the pixels PX51, PX52 and PX53 in the fifth row and the pixels PX61, PX62 and PX63 in the sixth row.

Figure 11:
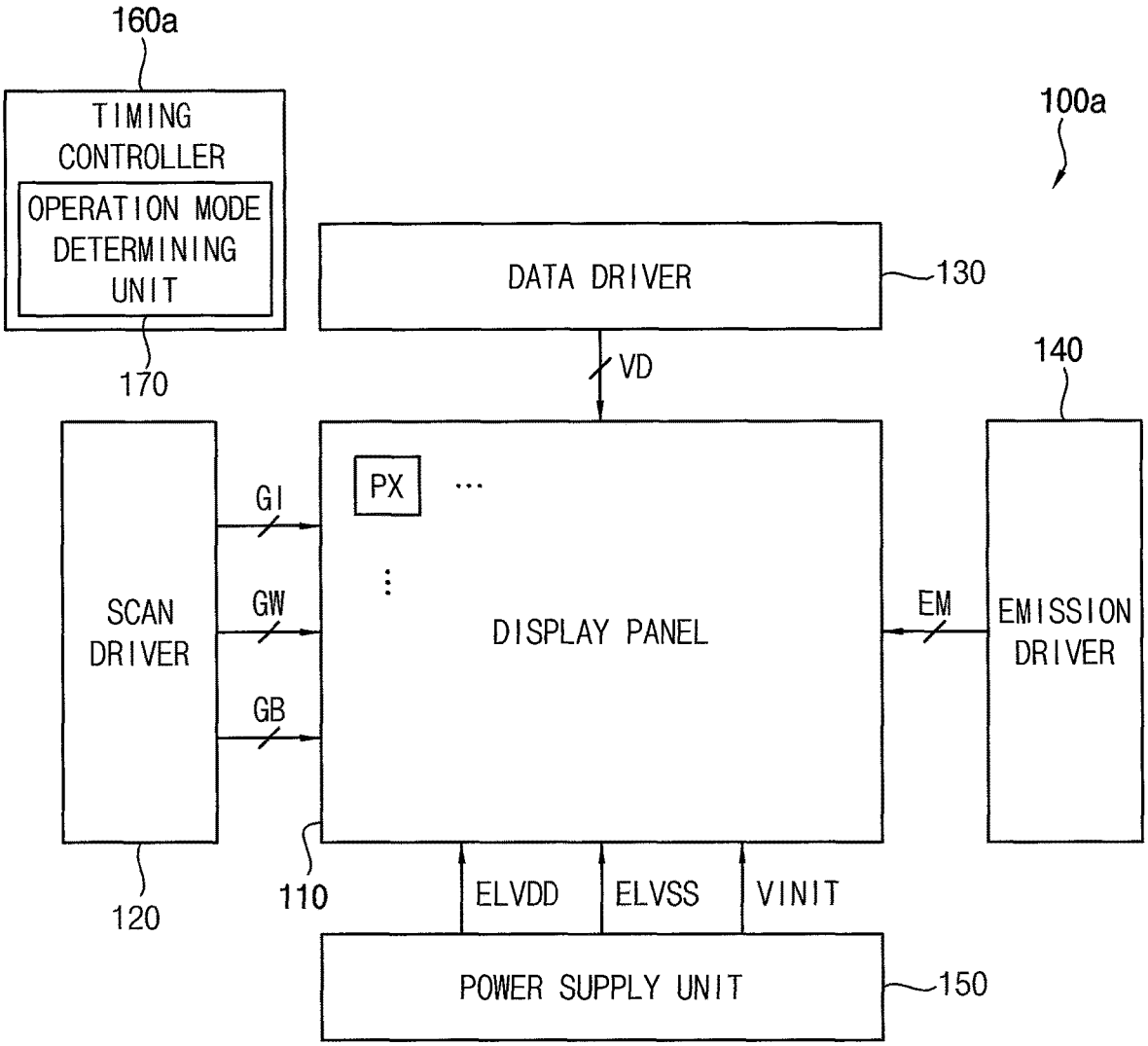
FIG. 11 is a block diagram illustrating an organic light emitting display device according to example embodiments.

FIG. 11 is a block diagram illustrating an organic light emitting display device according to example embodiments.

An organic light emitting display device 100*a* of FIG. 11 may have the same or similar configurations and operations to an organic light emitting display device 100 of FIG. 1, except that the organic light emitting display device 100*a* may further include an operation mode determining unit 170.

Referring to FIG. 11, the operation mode determining unit 170 may determine whether an operation mode of the organic light emitting display device 100*a* is a normal mode (or a still image mode) or a moving image mode. In some example embodiments, the operation mode determining unit 170 may be included in, but is not limited to, a timing controller 160*a*. The organic light emitting display device 100*a* according to example embodiments may selectively insert an initial period where driving transistors of a plurality of pixels PX are reset into each display frame according to the operation mode determined by the operation mode determining unit 170. In some example embodiments, the organic light emitting display device 100*a* may insert the initial period into each display frame in the moving image mode, and may not insert the initial period into each display frame in the normal mode.

Hereinafter, a method of operating the organic light emitting display device 100*a* according to example embodiments will be described below with reference to FIGS. 11 and 12.

Figure 12:
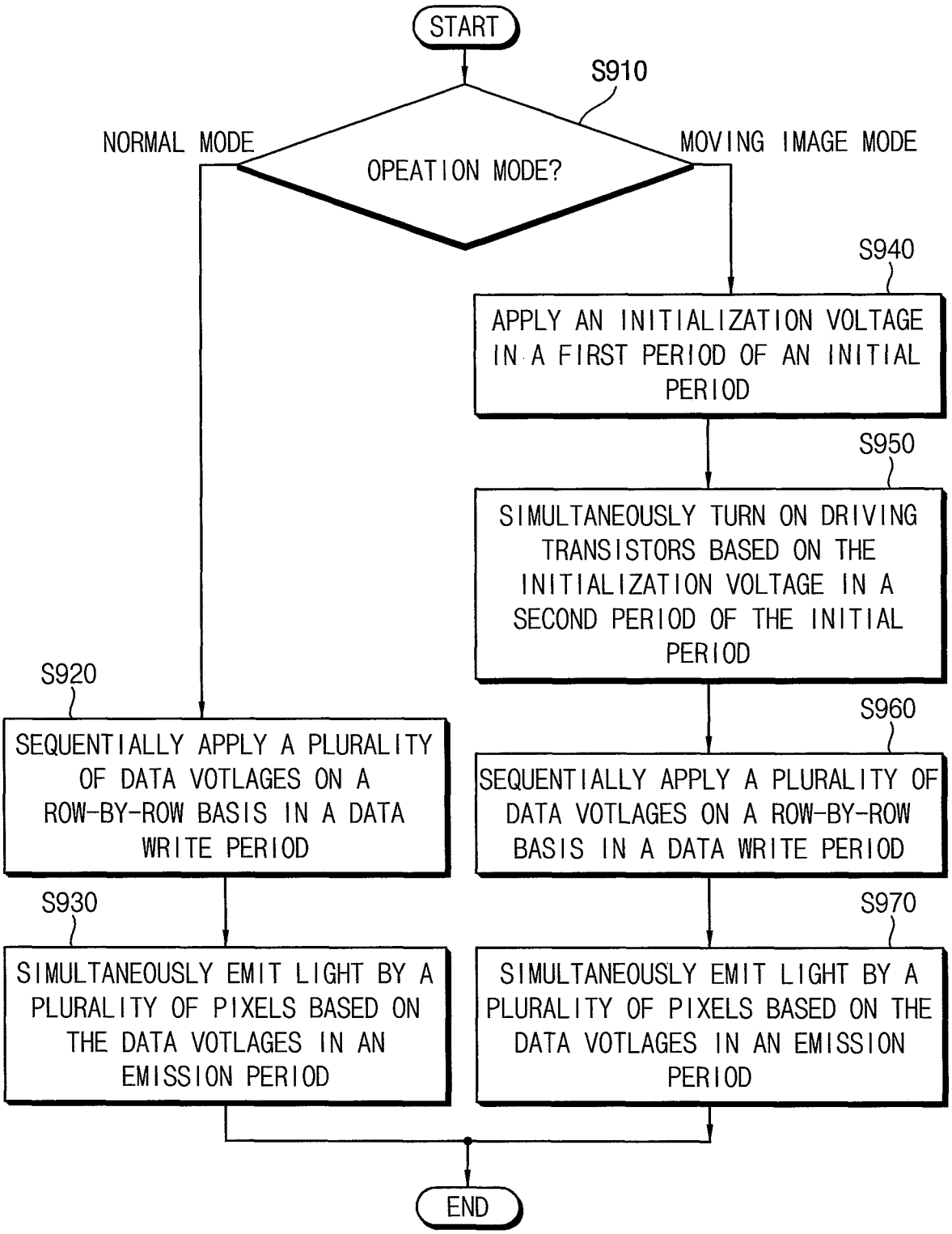
FIG. 12 is a flowchart illustrating a method of operating an organic light emitting display device according to example embodiments.

FIG. 12 is a flowchart illustrating a method of operating an organic light emitting display device according to example embodiments.

Referring to FIGS. 11 and 12, in a method of operating an organic light emitting display device 100*a* according to example embodiments, an operation mode determining unit 170 may determine whether an operation mode of the organic light emitting display device 100*a* is a normal mode (or a still image mode) or a moving image mode (S910). If the operation mode of the organic light emitting display device 100*a* is the normal mode (S910: NORMAL MODE), an initial period may not be included in each display frame, a plurality of data voltages VD may be sequentially applied on a row-by-row basis in a data write period (S920), and a plurality of pixels PX may concurrently (e.g., substantially simultaneously) emit light based on the plurality of data voltages VD in an emission period (S930).

If the operation mode of the organic light emitting display device 100*a* is the moving image mode (S910: MOVING IMAGE MODE), the initial period may be included in each display frame, an initialization voltage VINIT may be applied to the plurality of pixels PX in a first period of the initial period (S940), driving transistors of the plurality of pixels PX may be concurrently (e.g., substantially simultaneously) turned on based on the stored initialization voltage VINIT in a second period of the initial period (S950), the plurality of data voltages VD may be sequentially applied on the row-by-row basis in the data write period (S960), and the plurality of pixels PX may concurrently (e.g., substantially simultaneously) emit light based on the plurality of data voltages VD in the emission period (S970).

As described above, in the method of operating the organic light emitting display device 100*a* according to example embodiments, the initial period may be included in each display frame in the moving image mode, thereby preventing step efficiency that may occur when a moving image is displayed.

Figure 13:
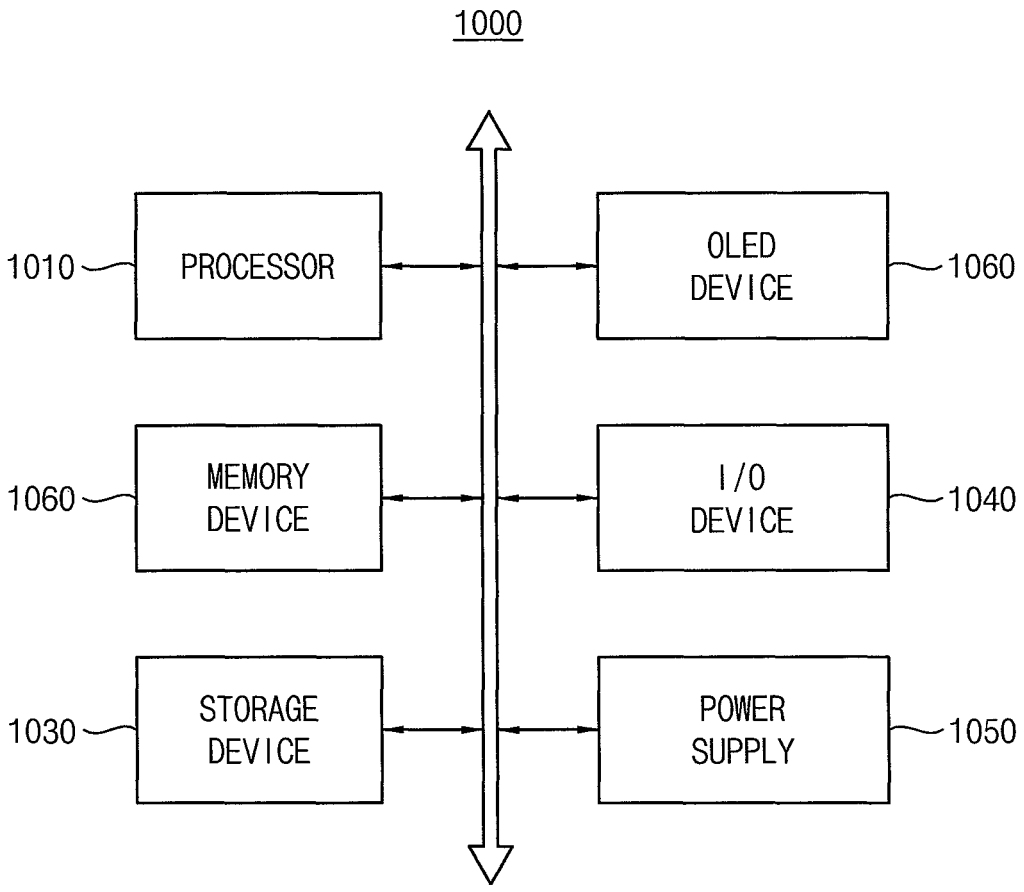
FIG. 13 is a block diagram illustrating an electronic device including an organic light emitting display device according to example embodiments.

FIG. 13 is a block diagram illustrating an electronic device including an organic light emitting display device according to example embodiments.

Referring to FIG. 13, an electronic device 1000 may include a processor 1010, a memory device 1020, a storage device 1030, an input/output (I/O) device 1040, a power supply 1050 and an organic light emitting display device 1060. The electronic device 1000 may further include a plurality of ports for communicating a video card, a sound card, a memory card, a universal serial bus (USB) device, other electronic devices, etc.

The processor 1010 may perform various computing functions or tasks. In some example embodiments, processor 1010 may be an application processor (AP), a central processing unit (CPU), a graphics processing unit (GPU), a microprocessor, etc. The processor 1010 may be coupled to other components via an address bus, a control bus, a data bus, etc. Further, the processor 1010 may be coupled to an extended bus such as a peripheral component interconnection (PCI) bus.

The memory device 1020 may store data for operations of the electronic device 1000. For example, the memory device 1020 may include at least one non-volatile memory device such as an erasable programmable read-only memory (EPROM) device, an electrically erasable programmable read-only memory (EEPROM) device, a flash memory device, a phase change random access memory (PRAM) device, a resistance random access memory (RRAM) device, a nano floating gate memory (NFGM) device, a polymer random access memory (PoRAM) device, a magnetic random access memory (MRAM) device, a ferroelectric random access memory (FRAM) device, etc., and/or at least one volatile memory device such as a dynamic random access memory (DRAM) device, a static random access memory (SRAM) device, a mobile DRAM device, etc.

The storage device 1030 may be a solid state drive (SSD) device, a hard disk drive (HDD) device, a CD-ROM device, etc. The I/O device 1040 may be an input device such as a keyboard, a keypad, a mouse device, a touchpad, a touchscreen, a remote controller, etc., and an output device such as a printer, a speaker, etc. The power supply 1050 may provide power for operations of the electronic device 1000. The organic light emitting display device 1060 may be coupled to other components via the buses or other communication links.

The organic light emitting display device 1060 may apply an initialization voltage to a plurality of pixels in a first period of an initial period, and may allow driving transistors of the plurality of pixels to be simultaneously turned on based on the initialization voltage in a second period of the initial period. Accordingly, hysteresis of the driving transistors may be reset in the initial period, and thus step efficiency and/or an instantaneous afterimage may be prevented.

The described embodiments and their equivalents may be applied to an organic light emitting display device 1060 and any electronic device 1000 including the organic light emitting display device 1060. For example, the described embodiments and their equivalents may be applied to a television (TV), a digital TV, a 3D TV, a smart phone, a mobile phone, a tablet computer, a personal computer (PC), a home appliance, a laptop computer, a personal digital assistant (PDA), a portable multimedia player (PMP), a digital camera, a music player, a portable game console, a navigation device, etc.

The foregoing is illustrative of example embodiments and is not to be construed as limiting thereof. Although a few example embodiments have been described, those skilled in the art will readily appreciate that many modifications are possible in the example embodiments without materially departing from the novel teachings and advantages of the present inventive concept. Accordingly, all such modifications are intended to be included within the scope of the present inventive concept as defined in the claims. Therefore, it is to be understood that the foregoing is illustrative of various example embodiments and is not to be construed as limited to the specific example embodiments disclosed, and that modifications to the disclosed example embodiments, as well as other example embodiments, are intended to be included within the scope of the appended claims and their equivalents.

What is claimed is:

1. A method of operating an organic light emitting display device comprising a plurality of pixels, the method comprising:

applying an initialization voltage from an initialization voltage supply to the plurality of pixels to store the initialization voltage in the plurality of pixels in a first period of an initial period;

concurrently turning on driving transistors of the plurality of pixels based on the stored initialization voltage in a second period of the initial period after the first period such that an on-current flows from a first power supply through the concurrently turned on driving transistors to the initialization voltage supply;

sequentially applying a plurality of data voltages to the plurality of pixels on a row-by-row basis to store the plurality of data voltages in the plurality of pixels in a data write period; and concurrently emitting light by the plurality of pixels based on the plurality of data voltages in an emission period.

2. The method of claim 1, wherein, in the second period of the initial period, a same on-current flows from the first power supply through the concurrently turned-on driving transistors into the initialization voltage supply, and hysteresis of the driving transistors is reset by the same on-current.

3. The method of claim 1, wherein the initialization voltage has an on-voltage level for turning on the driving transistors of the plurality of pixels in the first period of the initial period.

4. The method of claim 1, wherein the initialization voltage has a voltage level that is substantially the same as a voltage level of a white data voltage in the first period of the initial period.

5. The method of claim 1, wherein applying the initialization voltage to the plurality of pixels comprises:

sequentially applying a plurality of initialization control signals to initializing transistors of the plurality of pixels on the row-by-row basis to sequentially apply the initialization voltage to the plurality of pixels on the row-by-row basis in the first period of the initial period.

6. The method of claim 1, wherein applying the initialization voltage to the plurality of pixels comprises:

concurrently applying a plurality of initialization control signals to initializing transistors of the plurality of pixels to concurrently apply the initialization voltage to the plurality of pixels in the first period of the initial period.

7. The method of claim 1, wherein applying the initialization voltage to the plurality of pixels comprises:

applying a plurality of initialization control signals to initializing transistors of the plurality of pixels on a pixel block-by-pixel block basis to apply the initialization voltage to the plurality of pixels on the pixel block-by-pixel block basis in the first period of the initial period, where each pixel block includes at least two pixel rows.

8. The method of claim 1, wherein concurrently turning on the driving transistors of the plurality of pixels comprises:

concurrently applying a plurality of emission control signals to emission transistors of the plurality of pixels in the second period of the initial period.

9. The method of claim 8, wherein concurrently turning on the driving transistors of the plurality of pixels further comprises:

concurrently applying a plurality of bypass signals to bypass transistors of the plurality of pixels in the second period of the initial period.

10. The method of claim 1, further comprising:

changing a voltage level of a second power supply connected to organic light emitting diodes of the plurality of pixels such that the second power supply has a voltage level that is greater than or equal to that of the stored initialization voltage during the initial period.

11. The method of claim 1, further comprising:

determining whether an operation mode of the organic light emitting display device is a normal mode or a moving image mode, wherein the initial period is included in each display frame in the moving image mode, and is not included in each display frame in the normal mode.

12. An organic light emitting display device comprising:

a display panel comprising a plurality of pixels;

a scan driver configured to apply a plurality of scan signals, a plurality of initialization control signals and a plurality of bypass signals to the plurality of pixels;

a data driver configured to apply a plurality of data voltages to the plurality of pixels;

an emission driver configured to apply a plurality of emission control signals to the plurality of pixels; and a power supply unit configured to generate an initialization voltage, wherein storage capacitors of the plurality of pixels are configured to store the initialization voltage in a first period of an initial period, the initialization voltage being applied from the power supply unit to the plurality of pixels, wherein driving transistors of the plurality of pixels are configured to be concurrently turned on based on the stored initialization voltage in a second period of the initial period after the first period such that an on-current flows from a first power supply through the concurrently turned on driving transistors to an initialization voltage supply, wherein the plurality of data voltages are sequentially applied to the plurality of pixels on a row-by-row basis to store the plurality of data voltages in the plurality of pixels in a data write period; and wherein the plurality of pixels are configured to concurrently emit light based on the plurality of data voltages in an emission period.

13. The organic light emitting display device of claim 12, wherein the plurality of pixels store the plurality of data voltages in response to the plurality of scan signals that are sequentially applied on a row-by-row basis in the data write period, and wherein the plurality of pixels concurrently emit light based on the plurality of data voltages in response to the plurality of emission control signals that are concurrently applied in the emission period.

14. The organic light emitting display device of claim 12, wherein, in the second period of the initial period, a same on-current flows from the first power supply through the concurrently turned-on driving transistors into the initialization voltage supply, and hysteresis of the driving transistors is reset by the same on-current.

15. The organic light emitting display device of claim 12, wherein the initialization voltage has a voltage level that is substantially the same as a voltage level of a white data voltage in the first period of the initial period.

16. The organic light emitting display device of claim 12, wherein each of the plurality of pixels comprises:

the driving transistor;

the storage capacitor connected between a gate of the driving transistor and the first power supply;

a switching transistor configured to transfer the data voltage to a source of the driving transistor in response to the scan signal;

a compensating transistor configured to diode-connect the driving transistor in response to the scan signal;

an initializing transistor configured to apply the initialization voltage to the gate of the driving transistor and the storage capacitor in response to the initialization control signal;

a first emission transistor configured to connect the first power supply to the source of the driving transistor in response to the emission control signal;

a second emission transistor configured to connect a drain of the driving transistor to an organic light emitting diode in response to the emission control signal;

a bypass transistor configured to connect the initialization voltage supply to the organic light emitting diode in response to the bypass signal; and the organic light emitting diode connected between the second emission transistor and a second power supply.

17. The organic light emitting display device of claim 16, wherein the scan driver applies the plurality of initialization control signals to the initializing transistors of the plurality of pixels to store the initialization voltage in the storage capacitors of the plurality of pixels in the first period of the initial period.

18. The organic light emitting display device of claim 16, wherein the scan driver concurrently applies the plurality of bypass signals to the bypass transistors of the plurality of pixels in the second period of the initial period, and wherein the emission driver concurrently applies the plurality of emission control signals to the first and second emission transistors of the plurality of pixels in the second period of the initial period.

19. The organic light emitting display device of claim 16, wherein the second power supply has a voltage level that is greater than or equal to that of the stored initialization voltage during the initial period.

20. The organic light emitting display device of claim 16, further comprising:

an operation mode determining unit configured to determine whether an operation mode of the organic light emitting display device is a normal mode or a moving image mode, wherein the initial period is included in each display frame in the moving image mode, and is not included in each display frame in the normal mode.

* * * * *